US010823173B2

(12) United States Patent
Ait Bouziad et al.

(10) Patent No.: US 10,823,173 B2
(45) Date of Patent: Nov. 3, 2020

(54) ROTARY COMPRESSOR ARRANGEMENT WITH STATIONARY SHAFT WITH INLET AND OUTLET AND A CYLINDRICAL PISTON ROTATED BY A SATELLITE ELEMENT

(71) Applicant: NESTEC S.A., Vevey (CH)

(72) Inventors: Youcef Ait Bouziad, Echandens (CH); Nicolas Ganshof van der Meersch, Vufflens-le-Chateau (CH); Andre Noth, Pully (CH)

(73) Assignee: Societe des Produits Nestle S.A., Vevey (CH)

( * ) Notice: Subject to any disclaimer, the term of this patent is extended or adjusted under 35 U.S.C. 154(b) by 289 days.

(21) Appl. No.: 15/776,472

(22) PCT Filed: Nov. 14, 2016

(86) PCT No.: PCT/EP2016/077527
§ 371 (c)(1),
(2) Date: May 16, 2018

(87) PCT Pub. No.: WO2017/084991
PCT Pub. Date: May 26, 2017

(65) Prior Publication Data

US 2018/0328363 A1 Nov. 15, 2018

(30) Foreign Application Priority Data

Nov. 18, 2015 (EP) ..... 15195176

(51) Int. Cl.
*F04C 29/12* (2006.01)
*F04C 29/00* (2006.01)
*F04C 18/344* (2006.01)

(52) U.S. Cl.
CPC ..... *F04C 29/12* (2013.01); *F04C 18/3441* (2013.01); *F04C 29/0057* (2013.01); *F04C 2240/603* (2013.01)

(58) Field of Classification Search
CPC . F04C 2240/603; F04C 29/0057; F04C 29/12
See application file for complete search history.

(56) References Cited

U.S. PATENT DOCUMENTS 2,206,907 A * 7/1940 Loughridge ..... F16H 48/08 475/89
5,399,076 A 3/1995 Matsuda et al.
(Continued)

FOREIGN PATENT DOCUMENTS

CN 102338086 A 2/2012
CN 104100299 A 10/2014
(Continued)

*Primary Examiner* — Mary Davis
(74) *Attorney, Agent, or Firm* — K&L Gates LLP

(57) ABSTRACT

Rotary compressor arrangement (100) for compressing a fluid comprising a body (40) centered at an axis (X) of a shaft (20) and a cylindrical piston (10) eccentrically arranged with respect to the body (40) such that a compression chamber (110) is created between them; the arrangement (100) further comprising a satellite element (50) arranged at an offset axis (Y) and orbiting around the axis (X), the satellite element (50) contacting the external wall of the cylindrical piston (10) under a certain pressure or force such that the orbiting of the satellite element (50) entrains in rotation around the axis (X) the cylindrical piston (10) over the body (40); wherein the shaft (20) and the body (40) are solidary and static within the compressor arrangement (100); and wherein the shaft (20) comprises at least one inlet port (130) through which a compressible fluid is introduced into the compression chamber (110) for being compressed and/or one outlet port (140) through which the compressed fluid exits the compressor arrangement (100). Cooling/refrigerat-
(Continued)

ing system comprising such a rotary compressor arrangement (100).

15 Claims, 10 Drawing Sheets

(56) References Cited

U.S. PATENT DOCUMENTS

| | | | |
|---|---|---|---|
| 5,472,327 | A | 12/1995 | Strikis et al. |
| 8,607,762 | B2 | 12/2013 | Wooldridge et al. |
| 10,578,104 | B2 * | 3/2020 | Ganshof van der Meersch ..... F04C 29/0057 |

FOREIGN PATENT DOCUMENTS

| | | |
|---|---|---|
| DE | 102010040758 | 3/2012 |
| GB | 843188 | 8/1960 |

* cited by examiner

ROTARY COMPRESSOR ARRANGEMENT WITH STATIONARY SHAFT WITH INLET AND OUTLET AND A CYLINDRICAL PISTON ROTATED BY A SATELLITE ELEMENT

CROSS REFERENCE TO RELATED APPLICATIONS

The present application is a National Stage of International Application No. PCT/EP2016/077527, filed on Nov. 14, 2016, which claims priority to European Patent Application No. 15195176.1, filed on Nov. 18, 2015, the entire contents of which are being incorporated herein by reference.

FIELD OF THE INVENTION

The present invention is directed to a rotary compressor arrangement and, more specifically, to a rotary compressor arrangement of the vane type preferably used in a cooling or refrigerating system.

BACKGROUND OF THE INVENTION

Currently, different types of compressors are used in cooling or refrigeration systems. For home applications, vane rotary compressors are commonly used thanks to their reduced size.

Typically, a vane rotary compressor comprises a circular rotor rotating inside of a larger circular cavity configured by the inner walls of the compressor housing. The centers of the rotor and of the cavity are offset, causing eccentricity. Vanes are arranged in the rotor and typically slide into and out of the rotor and are tensioned to seal on the inner walls of the cavity, in order to create vane chambers where the working fluid, typically a refrigerant gas, is compressed. During the suction part of the cycle, the refrigerant gas enters through an inlet port into a compression chamber where the volume is decreased by the eccentric motion of the rotor and the compressed fluid is then discharged through an outlet port.

While small sized vane rotary compressors are advantageous, leaking of refrigerant through the surfaces of the inner walls of the compressor housing is disadvantageous. This is why these compressors also use lubricating oil, having two main functions: one is to lubricate the moving parts, and the second one is to seal the clearances between the moving parts, which minimizes gas leakage that can adversely affect the efficiency of the compressor.

Known in the state of the art are small sized compressors of the rotary vane type such as the one described in EP 1831561 B1, or as the one in KR 101159455, where a rotary vane compressor where a shaft joined to a rotor rotates guided by a plurality of ball bearings is disclosed. In both compressors, the inlet port where the gas is introduced and the outlet port through which the compressed gas exits are arranged in the housing of the compressor. Therefore, this housing has to be built with strict tolerances for maintianing tightness and also needs to be kept under high pressure, typically of about 30 bar, which makes the compressor arrangement both heavy and costly.

Also known from the state of the art is document U.S. Pat. No. 5,472,327 A, describing a rotary compressor arrangement comprising a body and a cylindrical piston eccentrically arranged with respect to the body, such that a chamber is created between them where the gas will be compressed. The suction or inlet port and the outlet port are arranged in different parts of the housing of the compressor, so this housing needs to be kept under high pressure, configuring a tank, which is again heavy and costly.

Document U.S. Pat. No. 5,399,076 A discloses a rotary compressor arrangement similar to that in U.S. Pat. No. 5,472,327 A, where an inlet port for the gas entry is arranged in the middle housing and an outlet port for the exit of the compressed gas is arranged in the end plate of the compressor. The front, middle, rear housing and the end plate contour and close the housing of the rotary compressor, configuring a tank maintained under pressure, again costly and heavy.

It is therefore an object of the present invention to configure a rotary compressor arrangement that overcomes the drawbacks of the arrangements of the prior art as it will be further explained, and which provides a rotary compressor arrangement efficient, small, light and not costly. The invention also aims at other objects and particularly the solution of other problems as will appear in the rest of the present description.

OBJECT AND SUMMARY OF THE INVENTION

According to a first aspect, the invention refers to a rotary compressor arrangement for compressing a fluid comprising a body centered at an axis X of a shaft and a cylindrical piston eccentrically arranged with respect to the body such that a compression chamber is created between them. The arrangement further comprises a satellite element arranged at an offset axis Y and orbiting around the axis X, such that the satellite element contacts the external wall of the cylindrical piston under a certain pressure or force such that the orbiting of the satellite element entrains in rotation around the axis X the cylindrical piston over the body. The shaft and the body are solidary and static within the compressor arrangement, the shaft comprising at least one inlet port through which a compressible fluid is introduced into the compression chamber for being compressed and/or one outlet port through which the compressed fluid exits the compressor arrangement.

Preferably, in the rotary compressor arrangement of the invention, the pressure surrounding the cylindrical piston is the suction pressure.

Typically, the rotary compressor arrangement of the invention further comprises at least one valve openable in order to allow the exit of the fluid, once compressed, from the compression chamber. This valve is typically a non-return valve, and preferably communicates with a distribution chamber, the said distribution chamber communicating with the outlet port in the shaft.

In the rotary compressor arrangement of the invention, the shaft is preferably configured as a conduit allowing a flow of fluid inside of it Typically, the rotary compressor arrangement further comprises at least one sealing piston slidable within the body during rotation of the cylindrical piston in such a way that it contacts the inner wall of the cylindrical piston and delimits the compression chamber.

Preferably, the inlet port and the valve are arranged each one on each one of the sides of the sealing piston in the close vicinity of the contact of the sealing piston with the inner wall of the cylindrical piston.

According to another embodiment, the rotary compressor arrangement can further comprise a plurality of sealing pistons configuring a plurality of compression chambers, the shaft comprising corresponding inlet ports, one per compression chamber and communicating with it. Typically, a plurality of valves, one per compression chamber, and communicating with it, will be provided in this configuration.

Preferably, a refrigerant gas and optionally lubricating oil are also provided together with the fluid in the compressor arrangement of the invention, the lubricating oil being compatible with the compressible fluid.

Typically, the rotary compressor arrangement of the invention further comprises an upper plate and a lower plate arranged to close in height in a tight manner at least one compression chamber created between the body and the cylindrical piston.

The rotary compressor arrangement preferably further comprises at least one segment element arranged between the upper and/or lower plates to allow a tight sealing of at least one compression chamber and the movement of the cylindrical piston. Typically, the at least one segment element comprises a low friction material.

According to a second aspect, the invention refers to a cooling/refrigerating system comprising a rotary compressor arrangement as the one just described.

BRIEF DESCRIPTION OF THE DRAWINGS

Further features, advantages and objects of the present invention will become apparent for a skilled person when reading the following detailed description of embodiments of the present invention, when taken in conjunction with the figures of the enclosed drawings.

DETAILED DESCRIPTION OF EXEMPLARY EMBODIMENTS

Figure 1A:
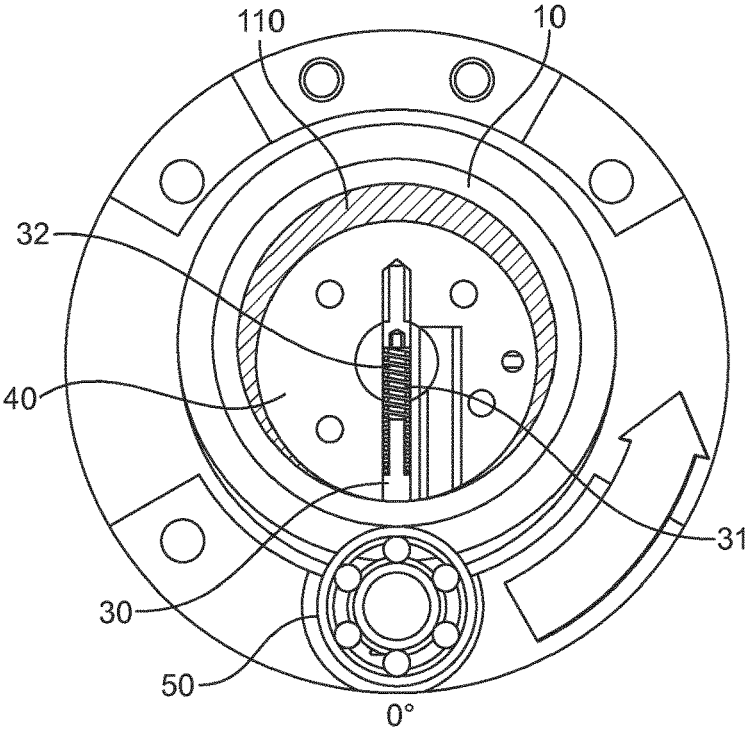
FIGS. 1*a-d* show different views in time of the movement of a rotary compressor arrangement according to the present invention.
Figure 1B:
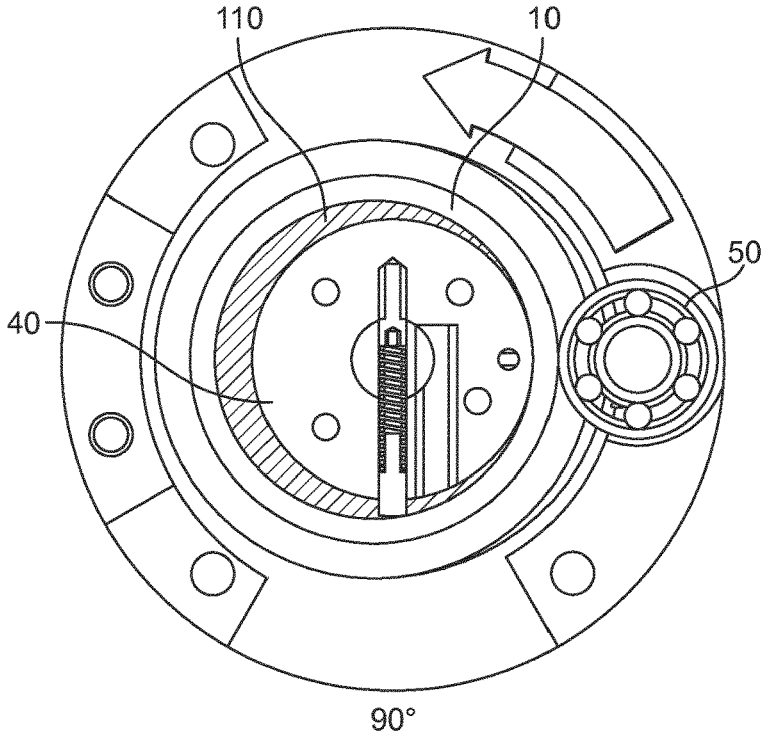
Figure 1C:
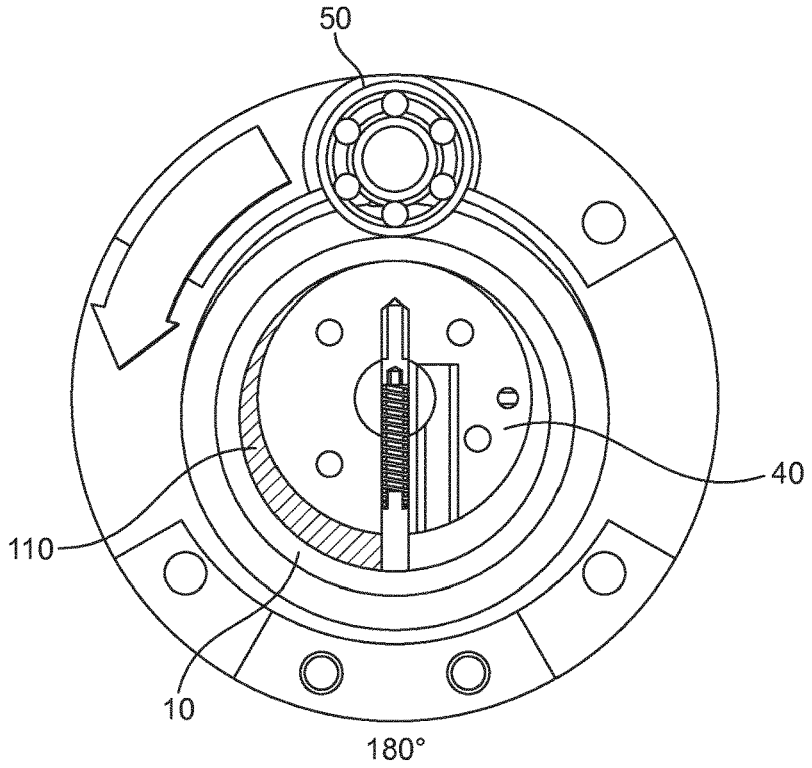
Figure 1D:
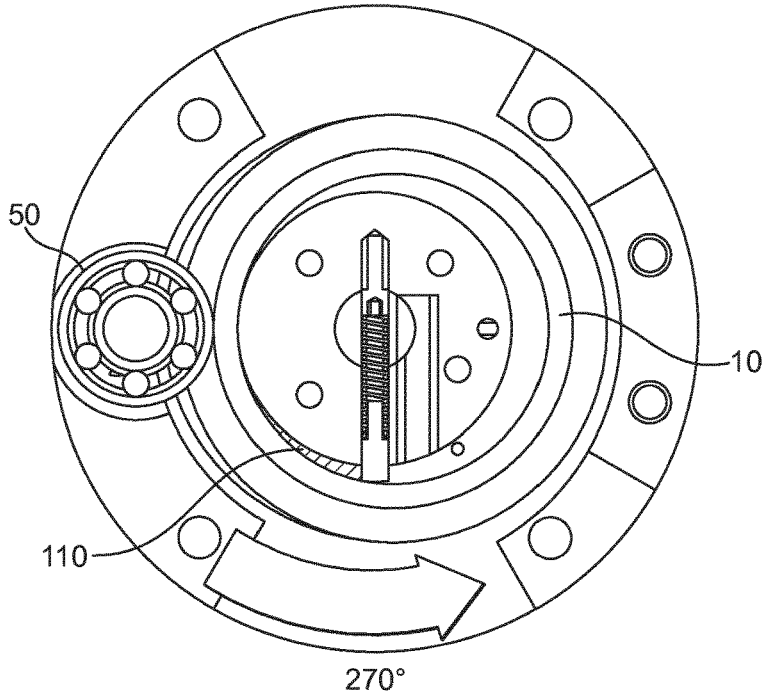

As shown in any of FIG. 2, 3, 4 or 5 for example, the present invention relates to a vane rotary compressor arrangement, called in what follows rotary compressor arrangement 100 or simply rotary compressor 100. The rotary compressor 100 of the invention is preferably used in cooling or refrigerating systems, and the working fluid is typically any compressible gas, preferably a refrigerant gas or a mixture comprising a refrigerant gas.

The compressor of the invention further comprises a cylindrical piston 10 inside of which a body 40 is arranged centered by an axis shaft X of a shaft 20. The compressor also comprises a vane or sealing piston 30 which can slide into a slot 31 in order to contact the internal walls of the cylindrical piston 10 and create a tight compression chamber where fluid will be compressed.

The arrangement of the invention has already been disclosed in patent application EP 15161944.2 belonging to the same applicant, and is made in such a way that the shaft 20 and the body 40 are one single piece within the rotary compressor 100 and are static. However, it is the cylindrical piston 10 which rotates around the body 40 (in fact, around the body 40 together with the shaft 20) entrained in rotation by means of a satellite element 50. The sealing piston 30 is slidable within the slot 31 arranged in the body 40: pressure is maintained in this slot 31 to make the sealing piston 30 contact the inner wall of the cylindrical piston 10 during the whole rotation of the cylindrical piston 10 with respect to the body 40. For this to happen the arrangement of the present invention comprises a tensioning device 32 inside the slot 31 exerting pressure over the sealing piston 30 so that it contacts the inner wall of the cylindrical piston 10: any kind of tensioning device providing such functionality can be used in the arrangement of the present invention, typically a spring, though a pneumatic device is also possible. In the arrangement of the present invention, as shown in FIGS. 1*a-d*, the sealing piston 30 creates a compression chamber 110 between the body 40 and the cylindrical piston 10 of a variable volume (the volume in the compression chamber 110 will decrease with the movement of the cylindrical piston with respect to the body, as represented for different times/angles of rotation in FIGS. 1*a-b-c-d*, thus compressing the fluid inside before it is discharged).

Therefore, the referential system in the rotary compressor 100 of the invention is actually inverted, the body 40 being fixed and the cylindrical piston 10 being the part rotating around the fixed body 40.

Thanks to the fact that the shaft 20 and the body 40 are one single piece within the rotary compressor 100 of the invention and are static, the inlet port 130 through which the working fluid enters the compression chamber 110 and the outlet port 140 through which this fluid, once compressed, exits the compressor 100 are both arranged in the shaft 20. This allows that the gas can be compressed directly from the inlet to the outlet without having to pass through a high pressure tank, which is the case in the known prior art arrangements and that would make the arrangement both heavy and costly. The approximate weight of the compressor arrangement of the invention would be of less than 2 kg, preferably around 1.6 Kg: typically, these values depend on the compressor power; these values correspond to rotational speeds of the compressor comprised between 5.000 rpm and 10.000 rpm, with a volume compressed of typically four times more than that in the known Aspen systems of the prior art (as shown for example in patent document EP 1831561 B1). Therefore, with the compressor arrangement of the invention, the rotational speeds are the same, but the system is able to compress a volume typically of four times the one in the known prior art, still maintaining the system very small and compact and less costly.

Figure 7A:
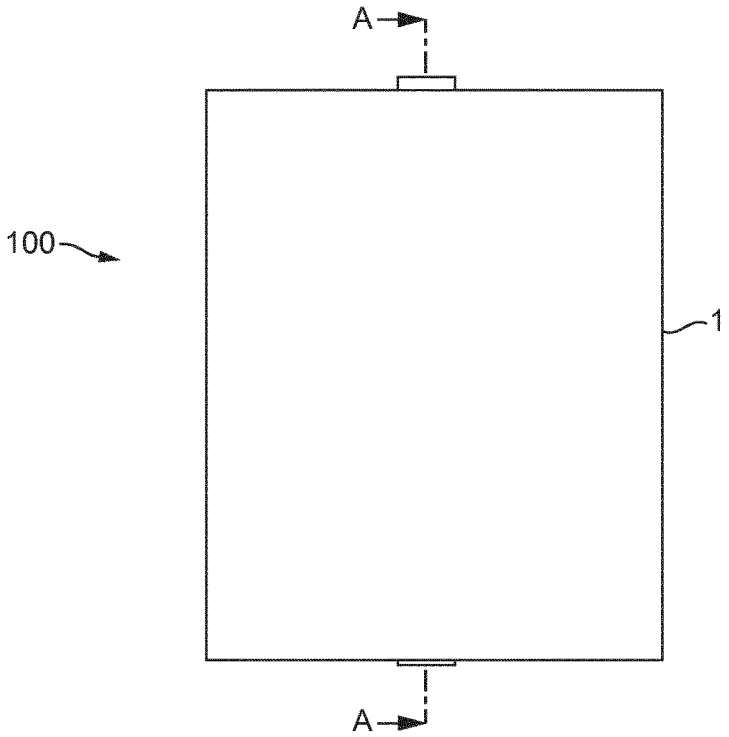
FIGS. 7*a-b* show the arrangement of the rotary compressor arrangement according to the present invention, showing the inlet and outlet ports for the working fluid.
Figure 7B:
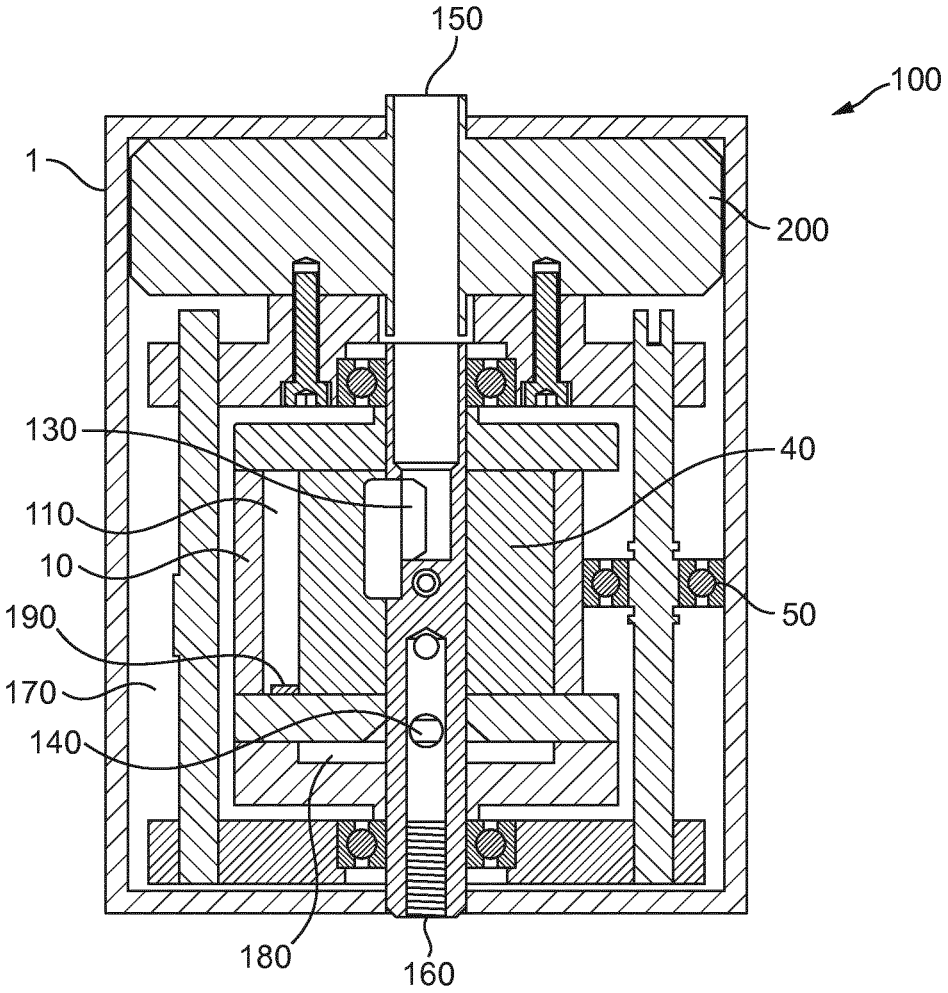

As shown in FIG. 7*b* (detailed cut view A-A of FIG. 7*a*), the fluid inlet 150 through which the fluid enters the compressor arrangement 100 is located at the upper side of the shaft 20. As the shaft is static, together with the body 40, and it is the cylindrical piston 10 which rotates around it, the inside of the shaft 20 can be made hollow and can be used as a conduit or pipe: thus, the fluid enters the inside of the shaft 20 through the upper fluid inlet 150, is conducted inside the shaft and exits the shaft, entering the compression chamber 110 through the inlet port 130, also arranged in the shaft 20 itself.

Once in the compression chamber 110, the fluid is compressed as the volume of this compression chamber 110 decreases, as shown in FIGS. 1*a* to 1*d*, by the movement of the cylindrical piston 10 over the body 40, when the sealing piston 30 contacts the inner walls of the cylindrical piston 10. When the fluid has been compressed inside the compression chamber 110, a non-return valve 190, which remains closed while the fluid inside the chamber 110 is compressed, is opened allowing the exit of the compressed fluid through it. The non-return valve allows the exit of the compressed fluid and prevents any return into other system parts. From the non-return valve 190, the compressed fluid is conveyed into a distribution chamber 180, from which it enters the shaft 20 through the outlet port 140. From there, the compressed fluid flows inside the shaft 20 (that is hollow) and exits the compressor arrangement through a fluid outlet 160, located at the lower part of the said shaft 20. The non-return valve 190 is arranged, as shown also in FIG. 7*b*, very close to the sealing piston 30; actually, to the area where the sealing piston 30 contacts the inner wall of the cylindrical piston 10, so it is more efficient and easier to discharge the compressed fluid.

Even when it is not clearly shown in the Figures attached, the inlet port 130 (through which the fluid enters the compression chamber 110) and the non-return valve 190 through which the compressed fluid exits the chamber, are arranged close to the sealing piston 30 (in fact, to the area where the sealing piston contacts the inner wall of the cylindrical piston 10). Actually, the inlet port 130 and the non-return valve 190 are arranged at both sides of the sealing piston, one on each of the sides, where the sealing piston 30 contacts the inner wall of the cylindrical piston 10.

As explained before, the non-return valve 190 is closed while the air is admitted and compressed into the compression chamber 110, and opens once it has been compressed and has to exit the mentioned chamber.

The inlet port 130 in the shaft 20 of the invention should be as big as possible in order to allow a good suction of the air from the fluid inlet 150 and into the compression chamber 110.

Thanks to the arrangement of the inlet and outlet ports just described, the injection of fluid is done directly into the compression chamber 110 so the system efficiency is very high. Moreover, there is no need to have a high pressure tank as in the systems known in the state of the art: in these systems, the exit of the compressed fluid is done through the housing so this needs to be maintained under pressure.

However, in the compressor arrangement 100 of the present invention, the arrangement is made more simple and still very highly efficient: in the external chamber 170 the suction pressure or intake pressure generated by the compressor while operating is maintained, and not the discharge pressure (i.e., the pressure generated on the output side of the gas compressor), as it is the case in systems of the known prior art. Typically, in refrigeration systems, the discharge pressure is aproximately ten times the suction pressure, so it is clear that the design and dimensioning of the components making up the compressor of the invention is much less demanding than that needed in the known prior art, which makes it possible that the compressor is much more compact and less costly, while being very efficient and providing higher power and compression ratios.

In the rotary compressor arrangement 100 of the invention, the pressure surrounding the cylindrical piston 10 is the suction pressure: in fact, even when a tank (recovery tank) surrounding the compressor is depicted in the Figures attached, the invention can also be made without any tank at all surrounding the compressor.

Figure 6:
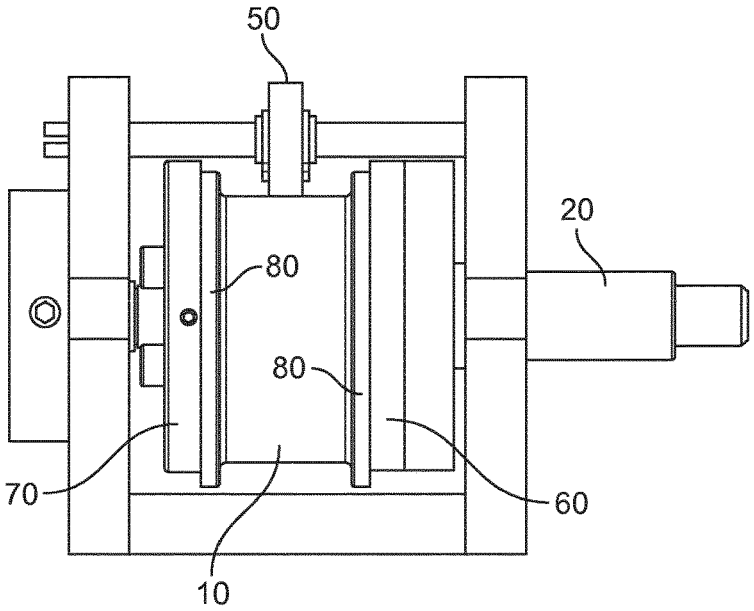
FIG. 6 shows the arrangement of the satellite axis with respect to the rotor shaft in a rotary compressor arrangement according to the present invention.

One of the goals to achieve with a rotary compressor arrangement 100 as the one of the invention is to obtain a high efficiency. As the cylindrical piston 10 is moving, the sealing is not perfect, and therefore there is a leakage in the system: the least the leakage is, the higher the efficiency. This leakage will depend on the gap between the cylindrical piston 10 and the fixed parts up and down (upper plate 60 and a lower plate 70, as shown in FIG. 6) and on the pressure difference between the inside and the outside of the cylindrical piston 10. Inside the cylindrical piston 10, the pressure is built during its rotation to reach the output pressure in a small area (small border around the cylindrical piston 10). In order to have a high efficiency, the border (circumference) needs to be reduced, where there is a high pressure difference around the cylindrical piston 10. This can be achieved by having a low pressure in the external chamber 170 (same as the input).

The above-mentioned arrangement can be achieved thanks to the shaft 20 is fixed and does not rotate. The shaft 20 can be fixed because the cylindrical piston 10 is driven by the external satellite element 50 and not by the axis or shaft itself, as it is the case in the compressors in the prior art.

Another target in the rotary compressor arrangement 100 of the invention is to reduce cost, which can be done by having the tank being under low pressure. In the configurations of the known prior art, the output pressure (up to 25 bars) must go through the tank because of the oil circuit. However, with the arrangement of the invention, the output pressure goes directly out without going through the tank: the tank pressure is substantially the same as the input pressure (around 3 bars). A low pressure tank is cheaper than a high pressure tank (which needs to be very strong), so the cost of the configuration of the invention is cheaper than that in the known prior art.

Another target in the rotary compressor arrangement 100 of the invention directed to cost reduction is that the motor 200 is arranged outside the compressor configuration: a motor has not 100% efficiency (normally from 30% to 90%) the rest being "heat energy". In the compressor configurations in the known prior art (and in most compressors existing in the market) the motor is inside the tank and the heat is mixed with the cooling gas, meaning that the "heat energy" is added in the cooling system, which must be evacuated through the radiator in the compressor. The radiator must be bigger to evacuate this extra energy. However, in the compressor arrangement of the invention, even when the motor 200 is placed still inside the tank, it is thermally separated. A motor can support a high temperature (up to 80° C.), the loss energy can be very easily evacuated to the ambient atmosphere (up to 40° C.) without going through the radiator.

Figure 8A:
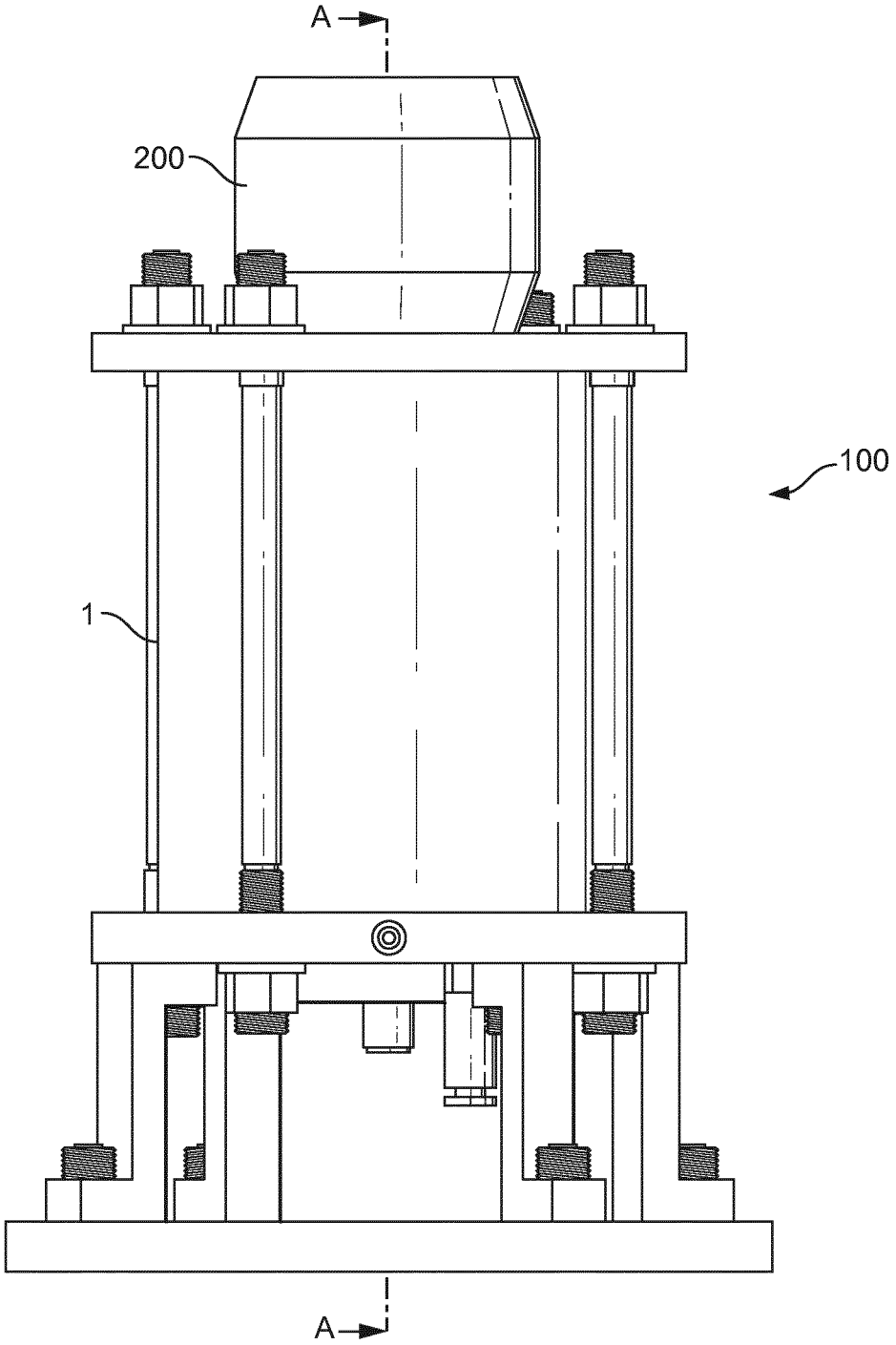
FIGS. 8*a-b-c* show different views in detail of the rotary compressor arrangement according to the present invention, as well as detailed views of the inlet and outlet ports for the working fluid.
Figure 8B:
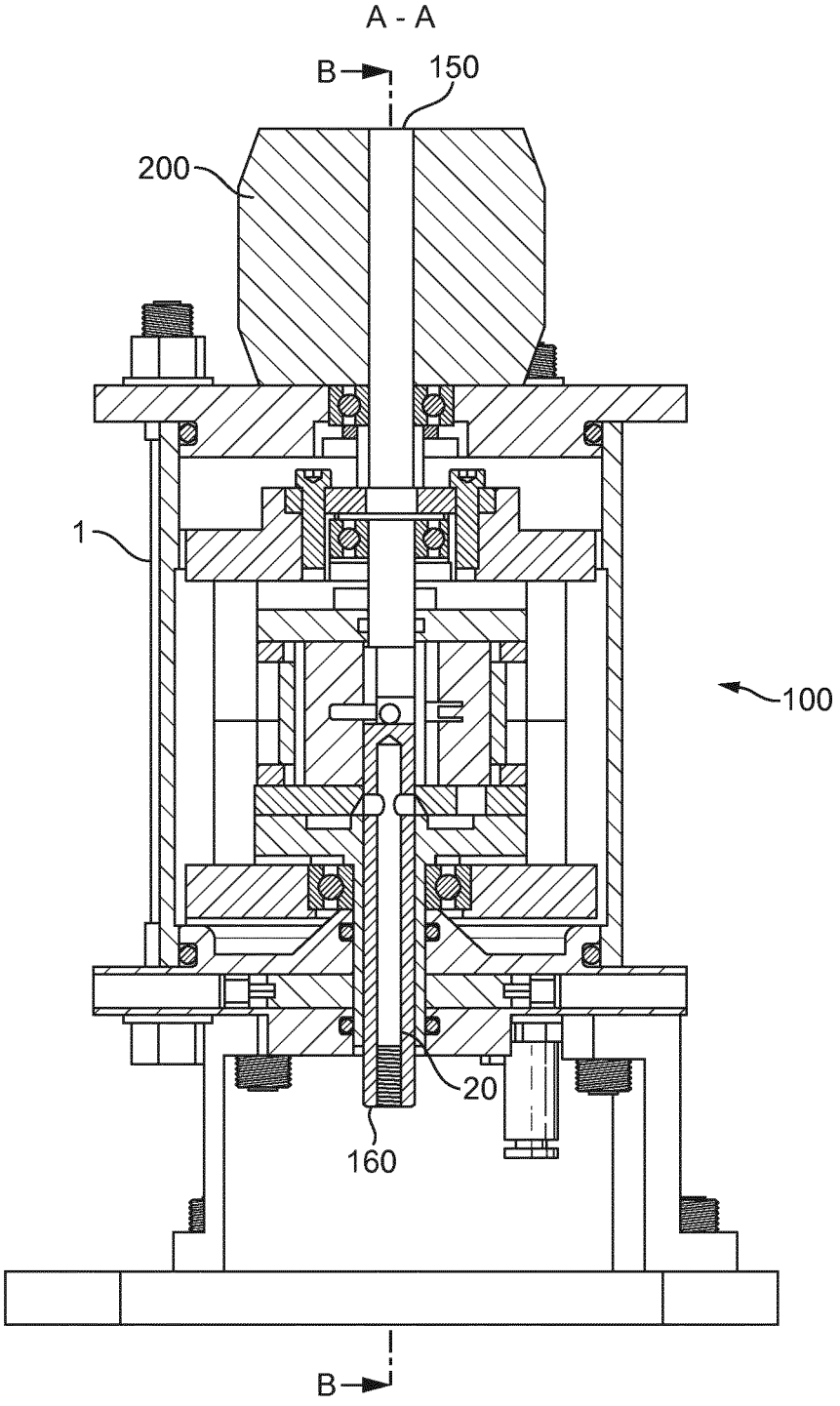
Figure 8C:
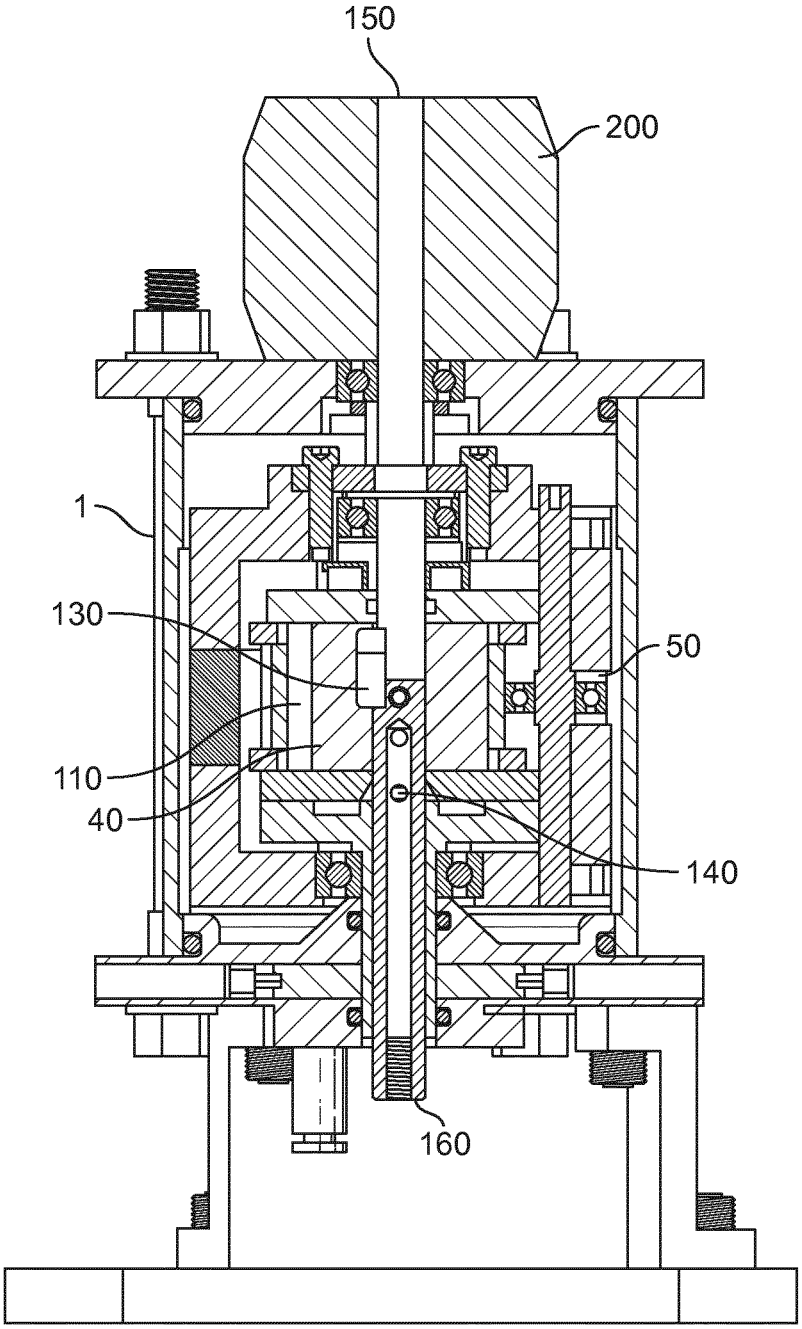
Figure 9:
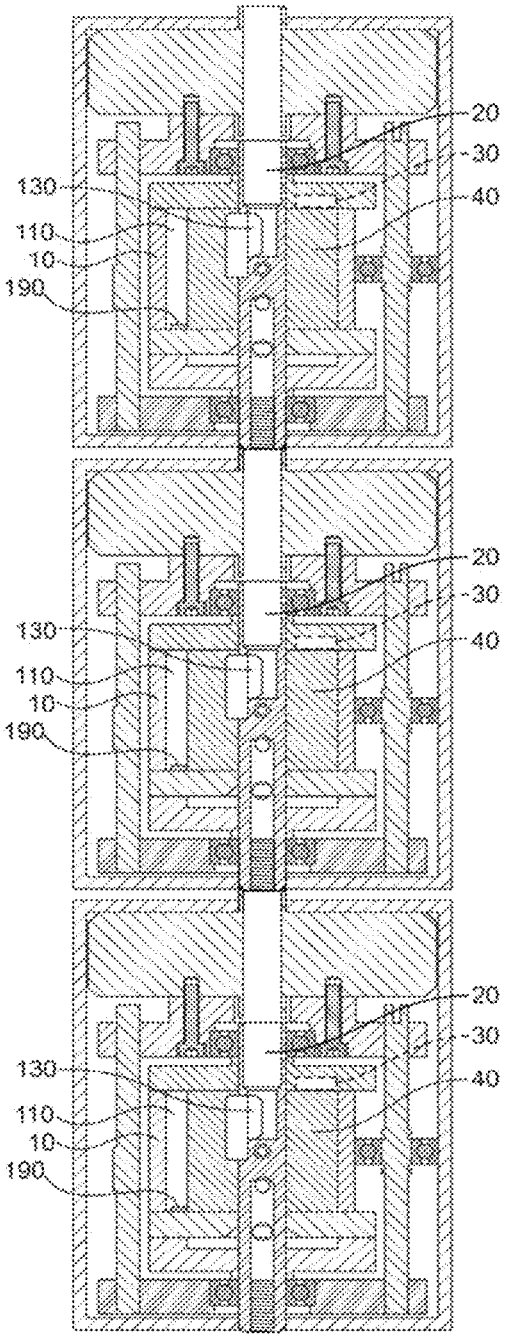
FIG. 9 shows the arrangement of the rotary compressor arrangement according to the present invention, showing more than one sealing pistons with more than one compression chambers, the shaft and corresponding inlet ports, and more than one valves.

FIGS. 8*a-c* show detailed views of the rotary compressor 100 of the invention and also of the shaft 20, fluid inlet 150, fluid outlet 160 and inlet and outlet ports 130, 140, respectively.

The Figures in the present patent application show one embodiment of the invention with only one sealing piston 30: however, it is also possible according to the invention and comprised within the scope of it, that the rotary compressor arrangement comprises more than one sealing piston 30, so more than one compression chamber 110 is formed between the body 40 and the cylindrical piston 10. In this case, there would be more than one non-return valves 190, one per each compression chamber, allowing the exit of the compressed fluid. Similarly, there will be also more than one inlet port 130 arranged in the shaft 20, one per each compression chamber.

As disclosed in patent application EP 15161944.2 of the same applicant, the rotary compressor 100 comprises a satellite element 50 as shown in any of FIGS. 1*a-d*, located offset, at an offset axis Y, with respect to the shaft axis X of the cylindrical piston 10. The satellite element 50 orbits around the cylindrical piston 10 and is arranged in such a way with respect to it that it entrains in rotation the cylindrical piston 10. In fact, the satellite element 50 contacts the external wall of the cylindrical piston 10 under certain pressure or force (i.e. the distance between the axis X and Y is such that this force is exerted and maintained during the whole orbiting of the satellite element): this contact of the satellite element 50 and the external wall of the cylindrical piston 10 under pressure makes that the satellite element 50 entrains in rotation the cylindrical piston 10 around the body 40, similar as in a gear arrangement. The satellite element 50 drives in rotation and also guides the cylindrical piston 10 around the body 40. The satellite element 50 rotates around its axis Y in a direction opposite to the direction of rotation which is entrained into the cylindrical piston 10. The main functions of the satellite element 50 are to guide and create the rotation of the cylindrical piston 10, exerting and maintaining a certain pressure between the external surface of the body 40 and the inner wall of the cylindrical piston 10 contacting the body 40, during the rotation of the cylindrical piston 10 around the body 40. Besides, the sealing piston 30 will be tightly contacting one part of the inner wall of the cylindrical piston 10 so that a tight compression chamber 110 is created having variable volume (decreasing with time) where the working fluid is compressed inside the compressor arrangement 100.

Figure 4:
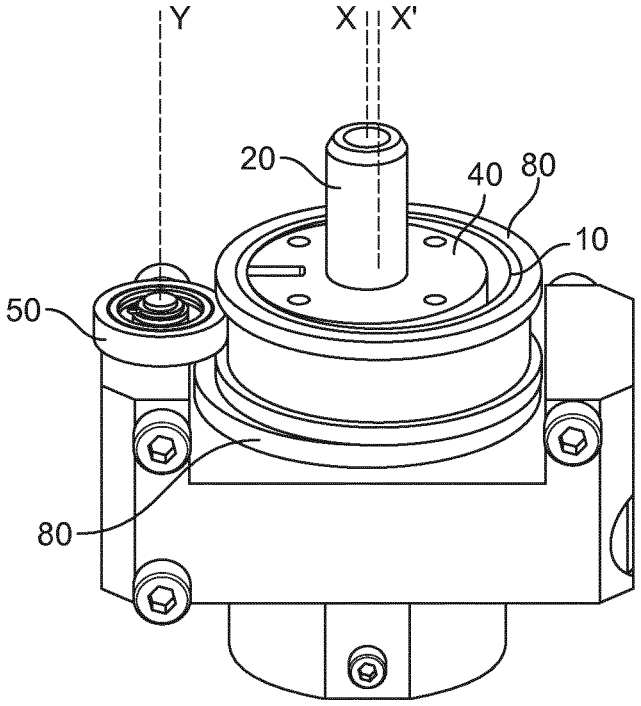
Figure 5:
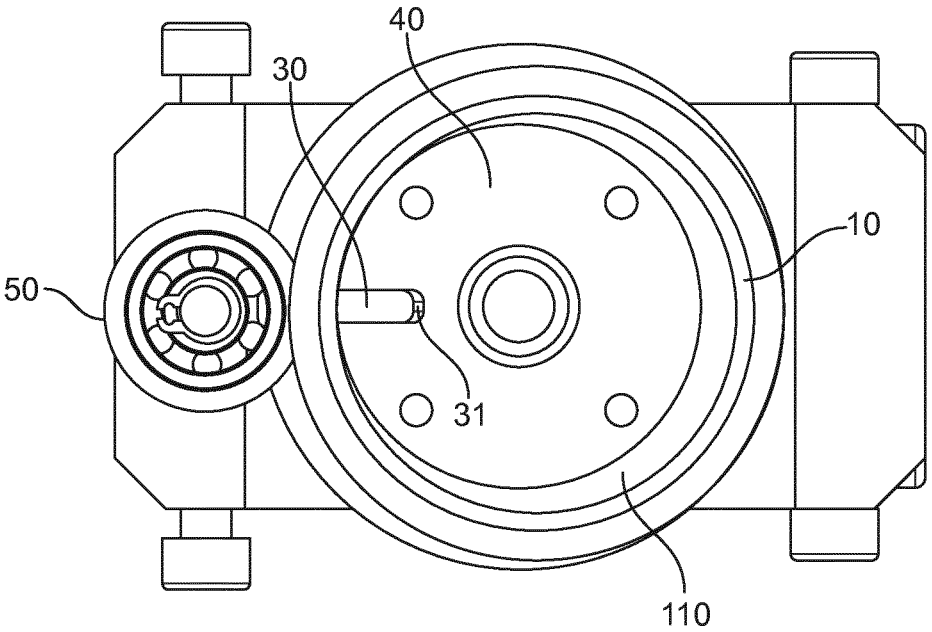
FIG. 5 shows a top view of the rotary compressor arrangement according to the present invention.

As shown in FIG. 4, the body 40 is centered according to a shaft axis X (the axis of the shaft 20), while the satellite element 50 is centered at an axis Y, called offset axis Y, which is offset with respect to the shaft axis X. As depicted in this Figure, the cylindrical piston 10 is centered according to an axis X' which has is arranged at a certain distance with respect to the shaft axis X: therefore, the body 40 and the cylindrical piston 10 are eccentrically arranged with respect to each other. According to the arrangement of the invention, the satellite element 50 presses over the external wall of the cylindrical piston 10 during the movement of the cylindrical piston 10 so that there is always a contact between the body 40 and the cylindrical piston 10 aiming at a substantially no-gap adjustment in this contact, so the distance between the offset axis Y and the shaft axis X, the distance between the offset axis Y and the cylindrical piston axis X' and the distance between the shaft axis X and the cylindrical piston axis X' are all maintained substantially constant during the rotation of the cylindrical piston 10 with respect to the body 40. In fact, the satellite element 50 presses over the external wall of the cylindrical piston 10 to obtain a no-gap adjustment between the body 40 and the inner walls of the cylindrical piston 10 at a contact point within the chamber 110 (see evolution in FIGS. 1*a-b-c-d*): the fact that there is substantially no gap at this point combined with the satellite element 50 orbiting around the shaft axis X has the effect of entraining in rotation the cylindrical piston 10 over the body 40. It is also evident from FIGS. 1*a-d* that this contact point is aligned with the location of the satellite element 50.

FIGS. 1*a*, 1*b*, 1*c* and 1*d* attached show in more detail different times in the movement of the satellite element 50 and the cylindrical piston 10 around the body 40: for the sake of clarity, a complete orbital movement of 360° of the satellite element 50 and, therefore, of the cylindrical piston 10 has been represented, for four specific moments in time, starting angle 0°, 90°, 180° and 270°. The positioning of the moving elements of the system, i.e. satellite 50 and cylindrical piston 10, with respect to the fixed element, i.e. body 40, is clearly represented in the above-mentioned Figures. The sealing piston 30 in fact only moves inside the slot 31 in order to always maintain proper contact with the inner walls of the moving cylindrical piston 10. This guarantees that the compression chamber 110 is tightly maintained so that the working fluid can be compressed inside it as its volume decreases with time (i.e. decreases with the rotation of the cylindrical piston 10 with respect to the body 40, shown for different times of movement of the satellite element 50 as represented in cited FIGS. 1*a-d*).

The satellite element 50 can be configured as a ball bearing, though it can be made into different configurations as long as they exert certain pressure and drive in rotation the cylindrical piston 10 during its rotation with respect to the body 40.

Furthermore, preferably according to the invention, the offset axis Y (or satellite element axis) is configured pre-stressed in order to have a certain flexibility, also allowing its calibration over the cylindrical piston 10: this ensures that the distance between axes X, Y is kept substantially constant during the rotation of the cylindrical piston 10, allowing that there is substantially no-gap adjustment between the external walls of the body 40 and the inner walls of the cylindrical piston 10 during the rotation of the cylindrical piston 10 over the body 40. This pre-stress allows the offset axis Y to work as a spring, pressing over the cylindrical piston 10 when needed or relieving tension over it when not needed, therefore adjusting this no-gap between the two.

Typically, the compressor of the invention works with a refrigerant gas as working fluid, and oil can also be entrained with the refrigerant in the compressor, in order to lubricate the moving parts and to seal the clearances or gaps between them. Oil is preferably introduced in the compressor by an oil pump (not shown) and there is also typically provided a device (not shown) to gather this oil and return it to the oil pump so that it is pumped once again together with the refrigerant. The lubricating oil may be any oil compatible with the refrigerant used as working fluid in the compressor. The refrigerant may be any suitable refrigerant that is effective in a given temperature range of interest.

FIGS. 7*b* and 8*a-b-c* show also the motor 200 entraining in rotation the satellite element 50 which entrains itself in rotation the cylindrical piston 10 over the shaft 20 and the body 40.

The shaft 20 is made symmetric with respect to the axial center of the compressor and is centered with the body 40, therefore it is made much more simple to manufacture compared to the existing solutions in the prior art.

Typically, the compressor arrangement of the invention also comprises an upper plate 60 and a lower plate 70, as shown in FIG. 6. The upper and lower plates 60, 70 close the upper and lower parts of the compressor, thus sealing the compression chamber 110 created together with the sealing piston 30. Both the upper and the lower plates 60, 70 are fixed on the shaft 20. The distance between the two surfaces, 60 and 70, and the height of the body configuring the cylindrical piston 10 must be precise in order to correctly seal and create the compression chamber 110.

Figure 2:
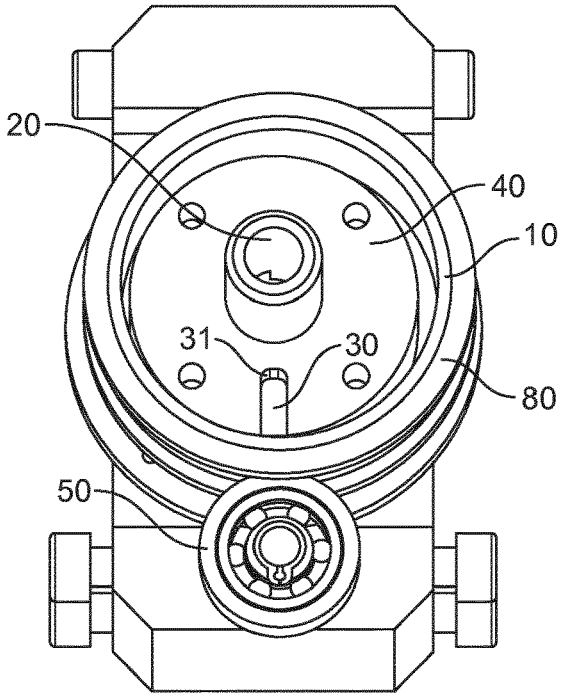
FIG. 2 shows a top side view of the rotary compressor arrangement according to the present invention.
Figure 3:
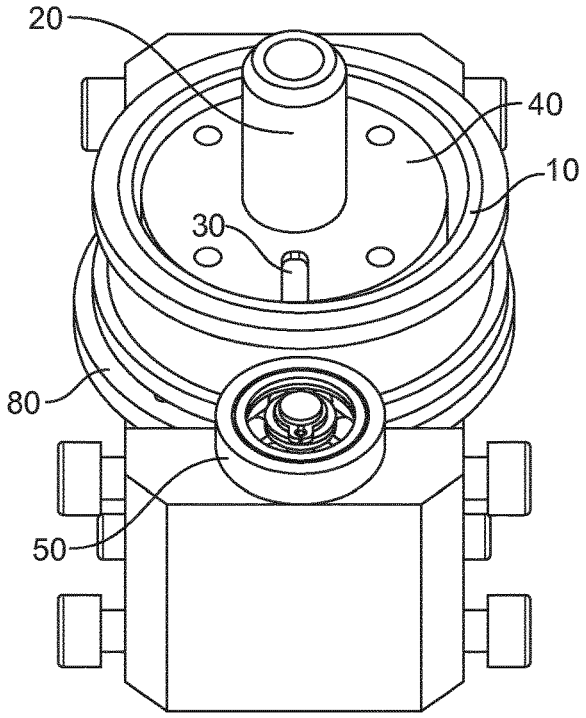
FIGS. 3 and 4 show side views of the rotary compressor arrangement according to the present invention.

According to the invention, as shown for example in FIG. 2 or 3, at least one segment element 80 is further arranged between the upper and/or lower plates 60, 70 to allow a tight sealing of the compression chamber 110 and at the same time allow the movement of the cylindrical piston 10. This arrangement is done in such a way that lower friction in the movement of the cylindrical piston 10 with respect to the body 40 and the plates 60, 70 is allowed. Preferably, the material configuring the segment element 80 is a low friction material, typically Teflon®. Typically, as depicted in FIG. 2 or 3, two separated segment elements 80 are arranged preferably outside the cylindrical piston 10: also, a guiding path is typically created (see FIG. 3) to cooperate and help the guidance of the satellite element 50.

These low friction materials allow long life solutions typically in applications where the sliding action of parts is needed, still with low maintenance being required. The friction characteristics of a material are given typically by the coefficient of friction, which gives a value showing the force exerted by a surface made of such a material when an object moves across it, such that a relative motion exists between the two, the object and the surface. Typically, for Teflon, this coefficient of friction is comprised between 0.04 and 0.2. Low friction materials have a coefficient of friction below 0.4, more preferably below 0.3 and even more preferably below 0.2.

Although the present invention has been described with reference to preferred embodiments thereof, many modifications and alternations may be made by a person having ordinary skill in the art without departing from the scope of this invention which is defined by the appended claims.

The invention claimed is:

1. Rotary compressor arrangement for compressing a fluid comprising a body centered at an axis of a shaft and a cylindrical piston eccentrically arranged with respect to the body such that a compression chamber is created between them;

the arrangement further comprising a satellite element arranged at an offset axis and orbiting around the axis, the satellite element contacting the external wall of the cylindrical piston under a certain pressure or force such that the orbiting of the satellite element entrains in rotation around the axis the cylindrical piston over the body;

the shaft and the body are solidary and static within the compressor arrangement; and the shaft comprises at least one inlet port through which a compressible fluid is introduced into the compression chamber for being compressed and/or one outlet port through which the compressed fluid exits the compressor arrangement.

2. Rotary compressor arrangement according to claim 1, wherein the pressure surrounding the cylindrical piston is the suction pressure.

3. Rotary compressor arrangement according to claim 1 further comprising at least one valve openable in order to allow the exit of the fluid, once compressed, from the compression chamber.

4. Rotary compressor arrangement according to claim 3, the valve being a non-return valve.

5. Rotary compressor arrangement according to claim 3, wherein the at least one valve communicates with a distribution chamber, the said distribution chamber communicating with the outlet port in the shaft.

6. Rotary compressor arrangement according to claim 1 wherein the shaft is configured as a conduit allowing a flow of fluid a flow of the fluid inside of the shaft.

7. Rotary compressor arrangement according to claim 1 comprising at least one sealing piston slidable within the body during rotation of the cylindrical piston in such a way that the as least one sealing piston contacts the inner wall of the cylindrical piston and delimits the compression chamber.

8. Rotary compressor arrangement according to claim 7, wherein the inlet port is located on one side of the sealing piston and a valve openable in order to allow the exit of the fluid from the compression chamber is located on the other side of the sealing piston, wherein the location of the inlet port and the valve are located at the respective sides of the sealing piston in close vicinity of the contact of the sealing piston with the inner wall of the cylindrical piston.

9. Rotary compressor arrangement according to claim 7 comprising the at least one sealing piston includes a plurality of sealing pistons configuring a plurality of compression chambers, the shaft comprising corresponding inlet ports, one per compression chamber and communicating with the corresponding inlet ports.

10. Rotary compressor arrangement according to claim 9, comprising a plurality of valves, one per compression chamber, and communicating with it.

11. Rotary compressor arrangement according to claim 1, wherein the fluid is a refrigerant that is provided with a lubricating oil that is compatible with the refrigerant.

12. Rotary compressor arrangement according to claim 1 comprising an upper plate and a lower plate arranged to close in height in a tight manner the at least one compression chamber created between the body and the cylindrical piston.

13. Rotary compressor arrangement according to claim 12 further comprising at least one segment element arranged between the upper and/or lower plates to allow a tight sealing of at least one compression chamber and the movement of the cylindrical piston.

14. Rotary compressor arrangement according to claim 13 wherein the at least one segment element comprises a low friction material.

15. Cooling/Refrigerating system comprising a rotary compressor arrangement for compressing a fluid comprising a body centered at an axis of a shaft and a cylindrical piston eccentrically arranged with respect to the body such that a compression chamber is created between them;

the arrangement further comprising a satellite element arranged at an offset axis and orbiting around the axis, the satellite element contacting the external wall of the cylindrical piston under a certain pressure or force such that the orbiting of the satellite element entrains in rotation around the axis the cylindrical piston over the body;

the shaft and the body are solidary and static within the compressor arrangement; and the shaft comprises at least one inlet port through which a compressible fluid is introduced into the compression chamber for being compressed and/or one outlet port through which the compressed fluid exits the compressor arrangement.

* * * * *